US010519717B2

(12) United States Patent
Pregeant et al.

(10) Patent No.: US 10,519,717 B2
(45) Date of Patent: Dec. 31, 2019

(54) PRESSURE COMPENSATION SYSTEM FOR A ROTARY DRILLING TOOL STRING WHICH INCLUDES A ROTARY STEERABLE COMPONENT

(71) Applicant: DOUBLEBARREL DOWNHOLE TECHNOLOGIES LLC, Houston, TX (US)

(72) Inventors: Michael Pregeant, Alvin, TX (US); Curtis Lanning, Montgomery, TX (US); Dan Seutter, Richmond, TX (US)

(73) Assignee: DOUBLEBARREL DOWNHOLE TECHNOLOGIES LLC, Houston, TX (US)

( * ) Notice: Subject to any disclaimer, the term of this patent is extended or adjusted under 35 U.S.C. 154(b) by 14 days.

(21) Appl. No.: 15/975,481

(22) Filed: May 9, 2018

(65) Prior Publication Data

US 2019/0345768 A1 Nov. 14, 2019

(51) Int. Cl.

| | |
|---|---|
| ***E21B 4/02*** | (2006.01) |
| ***E21B 10/22*** | (2006.01) |
| ***E21B 10/24*** | (2006.01) |
| ***E21B 4/00*** | (2006.01) |
| ***E21B 7/06*** | (2006.01) |
| ***E21B 7/02*** | (2006.01) |

(52) U.S. Cl.

CPC ..... *E21B 4/003* (2013.01); *E21B 4/02* (2013.01); *E21B 7/022* (2013.01); *E21B 7/06* (2013.01); *E21B 10/22* (2013.01); *E21B 10/24* (2013.01)

(58) Field of Classification Search

CPC ..... E21B 4/003; E21B 34/101; E21B 10/22; E21B 10/24; E21B 4/02

See application file for complete search history.

(56) References Cited

U.S. PATENT DOCUMENTS

| | | | | |
|---|---|---|---|---|
| 4,114,703 | A | 9/1978 | Matson, Jr. et al. | |
| 4,372,400 | A | 2/1983 | Beimgraben | |
| 5,419,405 | A * | 5/1995 | Patton | E21B 7/04 175/27 |
| 6,102,138 | A | 8/2000 | Fincher | |
| 6,244,361 | B1 | 6/2001 | Comeau et al. | |
| 6,347,674 | B1 | 2/2002 | Bloom et al. | |
| 6,415,878 | B1 | 7/2002 | Cargill et al. | |
| 6,467,557 | B1 | 10/2002 | Krueger et al. | |
| 6,569,020 | B1 | 5/2003 | Falgout, Sr. | |
| 6,837,315 | B2 | 1/2005 | Pisoni et al. | |
| 6,997,258 | B2 | 2/2006 | Homan et al. | |
| 7,083,008 | B2 | 8/2006 | Thorp et al. | |
| 7,258,171 | B2 | 8/2007 | Bourgoyne et al. | |
| 7,673,705 | B2 | 3/2010 | Gearhart et al. | |
| 8,739,897 | B2 | 6/2014 | Thorp et al. | |
| 9,016,401 | B2 | 4/2015 | Savage et al. | |

(Continued)

FOREIGN PATENT DOCUMENTS

| | | |
|---|---|---|
| WO | WO 2016053354 | 4/2016 |
| WO | WO 2017011186 | 1/2017 |

*Primary Examiner* — Cathleen R Hutchins

(74) *Attorney, Agent, or Firm* — McAfee & Taft

(57) ABSTRACT

Disclosed herein is a pressure compensation system for a bottom hole assembly. The disclosed pressure compensation system improves the responsiveness of a hydraulically actuated component carried by the bottom hole assembly.

18 Claims, 20 Drawing Sheets

(56) References Cited

U.S. PATENT DOCUMENTS

| | | | |
|---|---|---|---|
| 9,163,457 | B2 | 10/2015 | Marchand |
| 9,200,496 | B2 | 12/2015 | Reid |
| 9,435,157 | B2 | 9/2016 | Polyntsev |
| 9,464,521 | B2 | 10/2016 | Logan et al. |
| 9,869,140 | B2 | 1/2018 | Rushton |
| 2006/0254819 | A1 | 11/2006 | Moriarty |
| 2009/0133930 | A1 | 5/2009 | Thorp et al. |
| 2014/0231143 | A1 | 8/2014 | Marchand |
| 2015/0021097 | A1 | 1/2015 | Wesemeier et al. |
| 2015/0096737 | A1 | 4/2015 | Morrow |
| 2016/0319654 | A1 | 11/2016 | Rushton |
| 2017/0275954 | A1 | 9/2017 | Hagar |
| 2018/0002991 | A1 | 1/2018 | Patwa et al. |

* cited by examiner

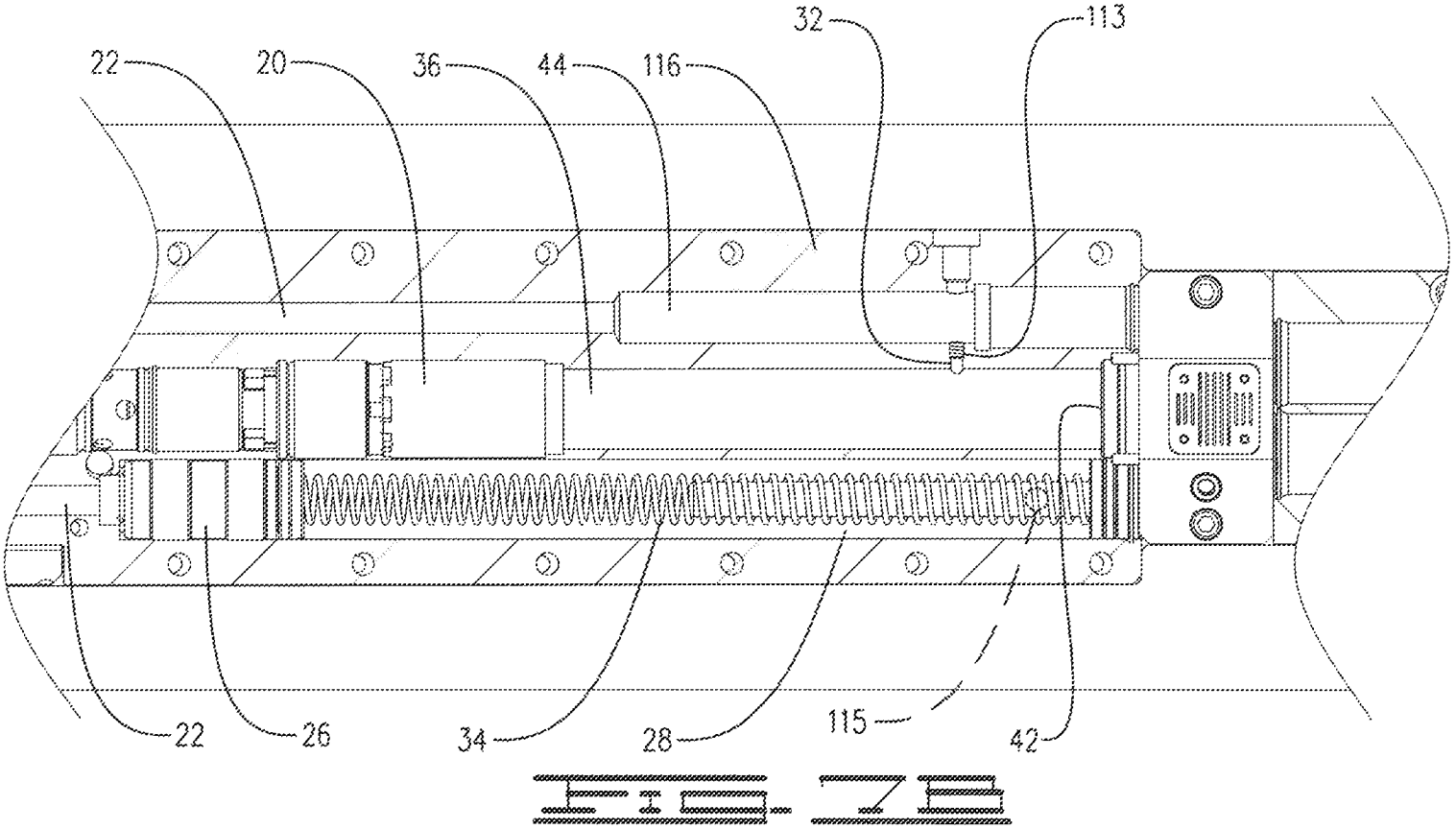
113
32
116
44
36
20
22
42
115
28
34
26
22

PRESSURE COMPENSATION SYSTEM FOR A ROTARY DRILLING TOOL STRING WHICH INCLUDES A ROTARY STEERABLE COMPONENT

BACKGROUND

A typical bottom hole assembly is depicted in FIG. 1. With reference to FIGS. 1-4 and 6A, the bottom hole assembly 10 may include elements such as a drill bit 12, a main housing 13, a rotary steerable system (RSS) 14 associated with a hydraulic block 16, a drive shaft 18, a shall lubricating block 60 and other components necessary for securing the drive shaft to the rotating drill string located above the shaft lubricating block.

With reference to FIGS. 2-4, hydraulic block 16 is mounted to main housing 13. Hydraulic block 16 contains a hydraulic pump 20, a hydraulic fluid reservoir 22 containing hydraulic fluid and appropriate passageways, not shown, for conveying hydraulic fluid to actuate the steering arms of RSS 14. Additionally, to provide for pressure compensation versus the ambient downhole pressure, hydraulic block 16 includes a compensation piston 26 located in a fluid passageway 28. On one side of compensation piston 26, fluid passageway 28 communicates with the exterior of hydraulic block 16 through port 77 and provides fluid communication for exterior drilling mud to exert ambient downhole pressure on compensation piston 26. On the other side of compensation piston 26, fluid passageway 28 communicates with hydraulic fluid reservoir 22. A spring 34 located on the drilling mud side of compensation piston 26 within fluid passageway 28 exerts an additional pressure on compensation piston 26. The additional pressure is sufficient to ensure that compensation piston 26 maintains hydraulic fluid reservoir 22 at a pressure greater than ambient pressure. Typically, spring 34 is selected to maintain hydraulic fluid reservoir 22 at a pressure of about 30 psi greater than the ambient drilling mud pressure. Spring rates for spring 34 may range from 5 psi to 50 psi.

During drilling operations, a delay in the operation of RSS 14 can result in misdirected wellbore. The combination of ambient drilling mud pressure and spring pressure acts on the hydraulic fluid within hydraulic fluid reservoir 22 to maintain a pressure greater than the ambient annulus pressure. Accordingly, performance of RSS 14 depends upon the action of drilling mud pressure and spring pressure on the hydraulic fluid within reservoir 22 to ensure that an adequate supply of hydraulic fluid is available at hydraulic pump 20.

Unfortunately, this configuration allows for the introduction of mud particles and other wellbore debris into fluid passageway 28. Overtime, the debris will reduce the reaction time of compensation piston 26 due to increased friction within passageway 28. Eventually, the accumulation of mud debris on the whole side of compensation piston 26 will freeze compensation piston 26. As a result, actuation of RSS 14 steering arms will be delayed due to an inadequate supply of hydraulic fluid resulting in a poorly drilled wellbore.

As depicted in FIGS. 2-4, hydraulic pump 20 is located in a separate passageway 36 from compensation piston 26. Hydraulic pump 20 divides passageway 36 into downhole and uphole regions. Located in the uphole region of passageway 36 is a floating piston 38. Floating piston 38 acts to balance pressure between hydraulic block 16 and shaft lubricating block 60. Finally, a plug 42, located uphole of floating piston 38, seals passageway 36. As depicted in FIG. 4, a fluid passageway 44 and port 32 provide fluid communication between hydraulic fluid reservoir 22 and the uphole area between floating piston 38 and plug 42. Thus, clean hydraulic fluid applies pressure to the uphole side of floating piston 38 while shaft oil from shaft lubricating block 60 passes through port 85 to apply pressure to the downhole side of floating piston 38.

As depicted in FIGS. 1-3, main housing 13 supports shaft lubricating block 60 at a position uphole of hydraulic block 16. Main housing 13 includes first and second bearings 62, 64 which provide supplemental support to drive shaft 18. Bearings 62 and 64 are located within oil reservoir 65. Thus, bearings 62, 64 are submerged in oil.

For proper operation, oil reservoir 65 must be maintained at a pressure greater than ambient pressure. To provide for this necessity, shaft lubricating block 60 includes passageways 74 and 76. Passageways 74 and 76 are divided into downhole and uphole regions by pistons 78, 80. A port 77 provides fluid communication between the downhole regions of fluid passageways 74 and 76 and the exterior of shaft lubricating block 60. As depicted in FIGS. 2-4, the uphole region of fluid passageways 74, 76 contains shaft oil and the downhole region contains drilling mud. Thus, drilling mud applies ambient pressure to the downhole side of pistons 78, 80. Typically, the springs 84, 86 associated with pistons 78, 80 are selected to ensure that the oil in oil reservoir 65 is maintained at about 30 psi above ambient borehole pressure. Spring rates for springs 84, 86 may range from 5 psi to 50 psi. In the prior art configuration of FIGS. 1-8, springs 84 and 86 do not provide any pressure compensation benefit to hydraulic block 16. Rather, in the prior art configuration compensation pressures generated by springs 84, 86 are balanced against the compensation pressure generated by spring 34 of hydraulic block 16 by floating piston 38.

As depicted in FIG. 3A, shaft oil flows through port 82 into oil reservoir 65 and across first and second bearings 62, 64 to port 85. Port 85 provides fluid communication with passageway 36 of hydraulic block 16. Thus, shaft oil passes from shaft lubricating block 60, through oil reservoir 65 of main housing 13 and into hydraulic block 16 where it contacts the downhole side of floating piston 38. As discussed above, fluid passageway 44 and port 32 provide fluid communication between hydraulic fluid reservoir 22 and the uphole area between floating piston 38 and plug 42.

The described configuration balances the pressures experienced by hydraulic block 16 and shaft lubricating block 60. However, overtime the lubricating fluid of shaft lubricating block 60 becomes contaminated with wear particles produced by rotating drive shaft 18. These contaminants will increase friction experienced by floating piston 38 and will lead to delayed movement on the part of floating piston 38 creating an imbalance of pressure between the two operating blocks. This imbalance of pressure could lead to leakage of lubricating fluid from shat lubricating block 60 into hydraulic block 16 contaminating the hydraulic fluid and disrupting steering operations. Additionally, bearings 62, 64 impede the flow of shaft oil from shaft lubricating block 60 to hydraulic block 16 as port 82 is located uphole of bearing 64 while port 85 is located downhole of bearing 62. Thus, shaft oil experiences a constricted flow path as it crosses each bearing. Thus, this configuration does not efficiently transfer hydraulic pressure from shaft lubricating block 60 to floating piston 38. Accordingly, the effective pressure experienced by floating piston 38 is less than expected which can result in a delay of steering arm deployment by the RSS. Any delay in steering arm deployment will increase steering error during drilling operations and increase operational costs.

The following disclosure describes an improved hydraulic block and improved shaft lubricating block. The improvements preclude the contamination of passageway 28 housing the compensation piston 26 with debris carried by the drilling mud. Additionally, the improvements provide for elimination of floating piston 38 from passageway 36.

SUMMARY

The present disclosure describes embodiments of an improved pressure compensation system suitable for use as a component of a downhole tool. One improved pressure compensation system includes a main housing supporting a hydraulically actuated tool, a shaft lubricating block, a hydraulic block and a drilling mud access port. A rotatable shaft passes through the main housing. The main housing includes a shaft oil reservoir containing shaft oil, a first bearing supporting the shaft passing through the main housing and a second bearing supporting the shaft passing through the main housing. The first and second bearings are immersed in the shaft oil contained within the shaft oil reservoir. The shaft lubricating block includes at least one shaft lubricating block passageway having an uphole end and a downhole end. Positioned within the shaft lubricating block passageway is a piston positioned. The piston has an uphole side and a downhole side and the piston divides the at least one shaft lubricating block passageway into an uphole region and a downhole region. A first fluid port provides fluid communication between the at least one shaft lubricating block passageway and the shaft oil reservoir. The first fluid port is located downhole of the first bearing. The uphole region of the at least one shaft lubricating block passageway contains shaft oil. Additionally, a spring located in either the uphole region or the downhole region of the at least one shaft lubricating block passageway applies a biasing force against the piston such that the piston applies pressure to shaft oil located within the shaft oil reservoir. The hydraulic block includes a first hydraulic block passageway having an uphole end and a downhole end. Positioned within the first hydraulic block passageway is a piston having an uphole side and a downhole side. The piston divides the first hydraulic block passageway into an uphole region and a downhole region. A second fluid port provides fluid communication between the uphole side of the first hydraulic block passageway and the shaft oil reservoir. The second fluid port is located uphole of the second bearing. The drilling mud access port is in fluid communication with the downhole region of the at least one passageway of the shaft lubricating block.

The present disclosure describes embodiments of an improved pressure compensation system suitable for use as a component of a downhole tool. One improved pressure compensation system includes a main housing supporting a hydraulically actuated tool, a shaft lubricating block, a hydraulic block and a drilling mud access port. A rotatable shaft passes through the main housing. The main housing includes a shaft oil reservoir containing shaft oil, a first bearing supporting the shaft passing through the main housing and a second bearing supporting the shaft passing through the main housing. The first and second bearings are immersed in the shaft oil contained within the shaft oil reservoir. The hydraulic block includes first hydraulic block passageway having uphole end and a downhole end. Positioned within the first hydraulic block passageway is a piston having an uphole side and a downhole side. The piston divides the first hydraulic block passageway into an uphole region and a downhole region. A first fluid port provides fluid communication between the uphole side of the first hydraulic block passageway and the shaft oil reservoir. The first fluid port is located uphole of the second bearing. A spring is located in either the uphole or downhole region of the first hydraulic block passageway. Located within the hydraulic block is a hydraulic fluid reservoir containing hydraulic fluid. A second port provides fluid communication between the hydraulic fluid reservoir and the downhole region of the first hydraulic block passageway. A second hydraulic block passageway houses a hydraulic pump and is in fluid communication with the hydraulic fluid reservoir. A third hydraulic block passageway provides fluid communication between the hydraulic pump and the hydraulically actuated tool. The configuration of the hydraulic block precludes fluid communication between the first, second and third passageways of the hydraulic block and the exterior of the downhole tool.

The present disclosure describes embodiments of an improved pressure compensation system suitable for use as a component of a downhole tool. One improved pressure compensation system includes a main housing supporting a hydraulically actuated tool, a shaft lubricating block, a hydraulic block and a drilling mud access port. A rotatable shaft passes through the main housing. The main housing includes a shaft oil reservoir containing shaft oil, a first bearing supporting the shaft passing through the main housing and a second bearing supporting the shaft passing through the main housing. The first and second bearings are immersed in the shaft oil contained within the shaft oil reservoir. The hydraulic block includes a first hydraulic block passageway having an uphole end and a downhole end. Positioned within the first hydraulic block passageway is a piston having an uphole side and a downhole side. The piston divides the first hydraulic block passageway into an uphole region and a downhole region. A first fluid port provides fluid communication between the uphole side of the first hydraulic block passageway and the shaft oil reservoir. The first fluid port is located whole of the second bearing. A spring is located in either the uphole or downhole region of the first hydraulic block passageway. The whole region of said first hydraulic block passageway contains shaft oil. Located within the hydraulic block is a hydraulic fluid reservoir containing hydraulic fluid. A second port provides fluid communication between the hydraulic fluid reservoir and the downhole region of the first hydraulic block passageway. A second hydraulic block passageway houses a hydraulic pump and is in fluid communication with the hydraulic fluid reservoir. The hydraulic pump divides the second hydraulic block passageway into a downhole region and an whole region. The uphole region of the second hydraulic passageway does not contain a floating piston. A third hydraulic block passageway provides fluid communication between the hydraulic pump and the hydraulically actuated tool.

BRIEF DESCRIPTION OF THE DRAWINGS

FIG. 3B is a side cut-away view depicting the internal passageways of the prior art hydraulic block as identified in portion 3B of FIG. 3A.

FIG. 3C is a side cut-away view depicting the internal passageways of the prior art shaft lubricating block as identified in portion 3C of FIG. 3A.

FIG. 6B is a side cut-away view depicting the internal passageways of an improved hydraulic block as identified in portion 6B of FIG. 6A.

FIG. 6C is a side cut-away view depicting the internal passageways of an improved shaft lubricating block as identified in portion 6C of FIG. 6A.

FIG. 6D is a side cut-away view depicting the internal passageways of an improved shaft lubricating block as identified in portion 6C of FIG. 6A with the spring depicted on the downhole side of the piston.

FIG. 8 is an exploded view of an improved pressure compensation system depicting components of the hydraulic block and shaft lubricating block.

DETAILED DESCRIPTION

Figure 1:
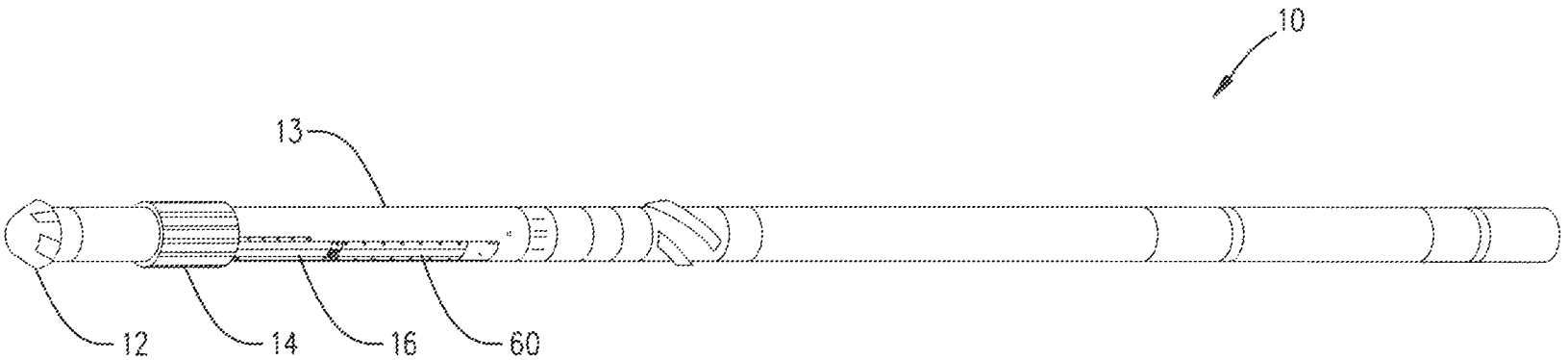
FIG. 1 PRIOR ART
FIG. 1 depicts a typical prior art downhole bottom assembly.
Figure 2A:
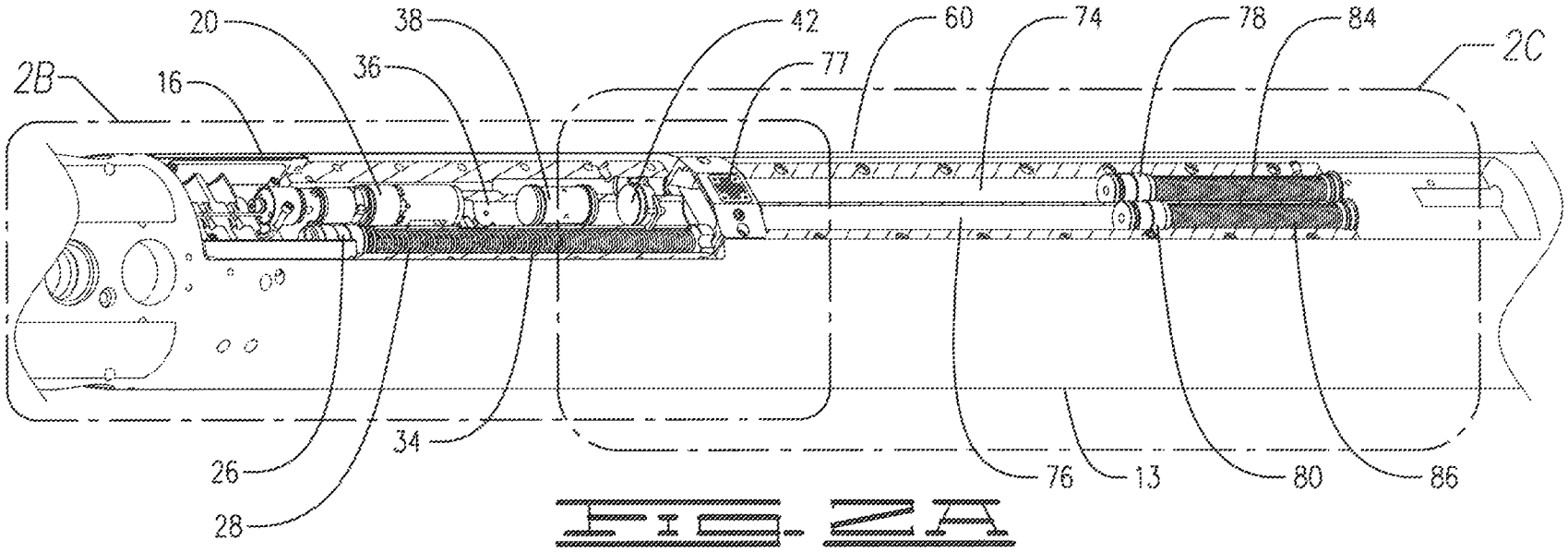
FIG. 2A PRIOR ART
FIG. 2A is a perspective cut-away view of a prior art hydraulic block and shaft lubricating block mounted to a main housing.
Figure 2B:
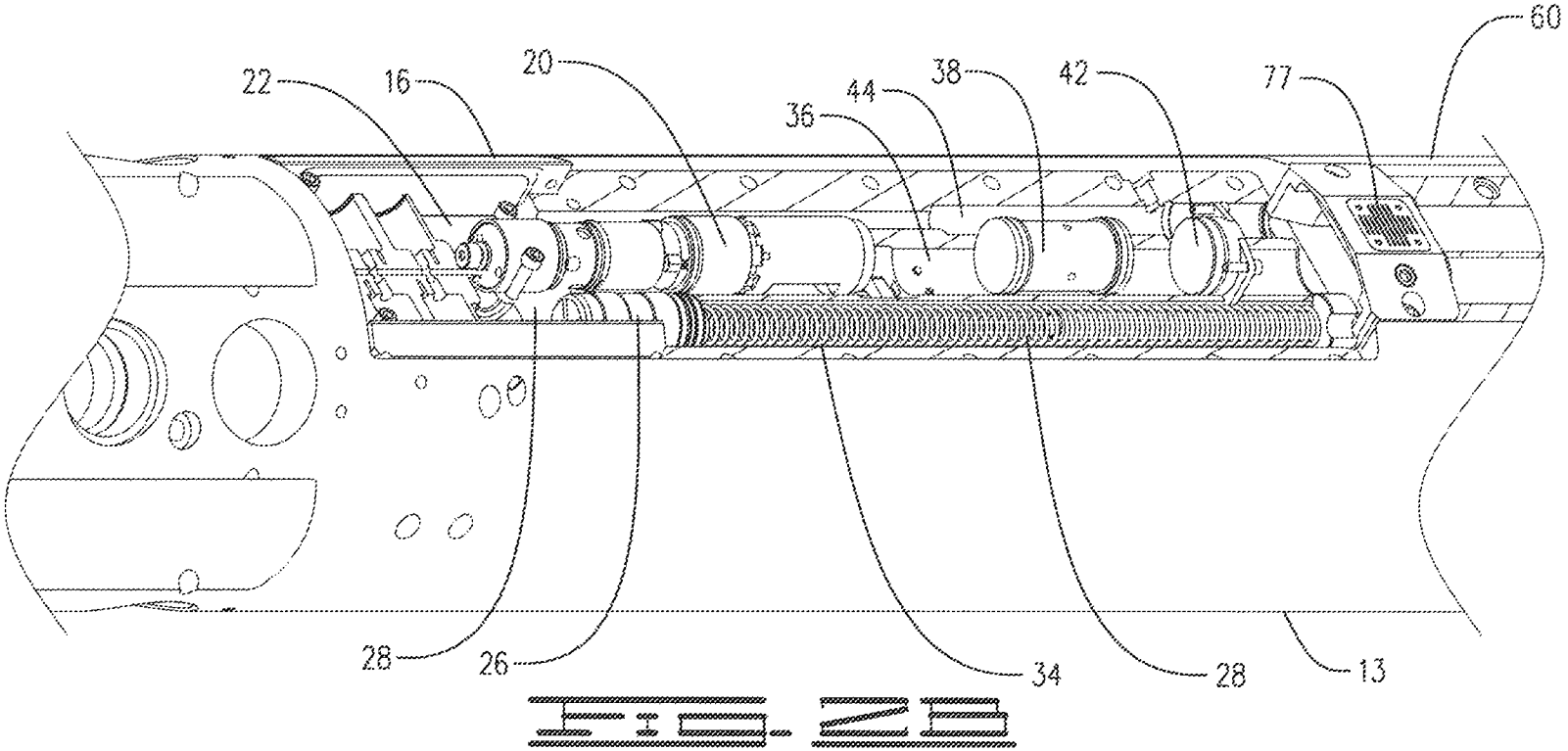
FIG. 2B PRIOR ART
FIG. 2B is a perspective cut-away view of a prior art hydraulic block as identified in portion 2B of FIG. 2A.
Figure 2C:
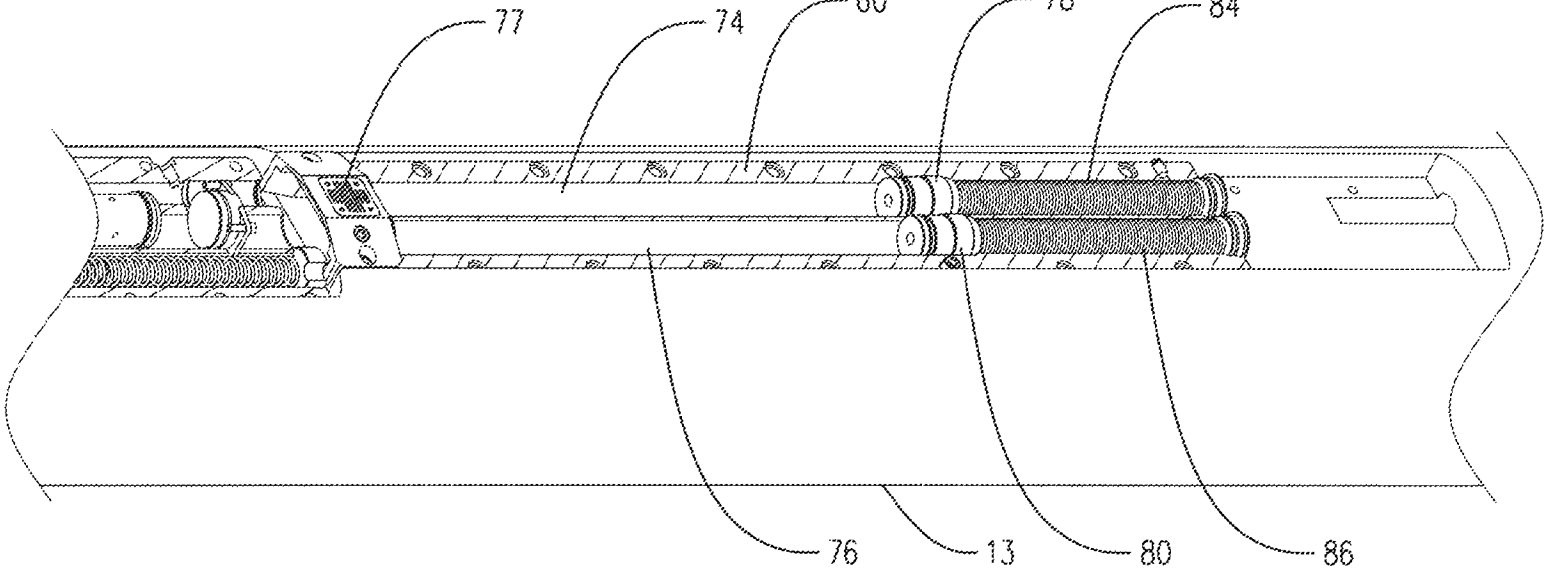
FIG. 2C PRIOR ART
FIG. 2C is a perspective cut-away view of a prior art shaft lubricating block as identified in portion 2C of FIG. 2A.
Figure 3A:
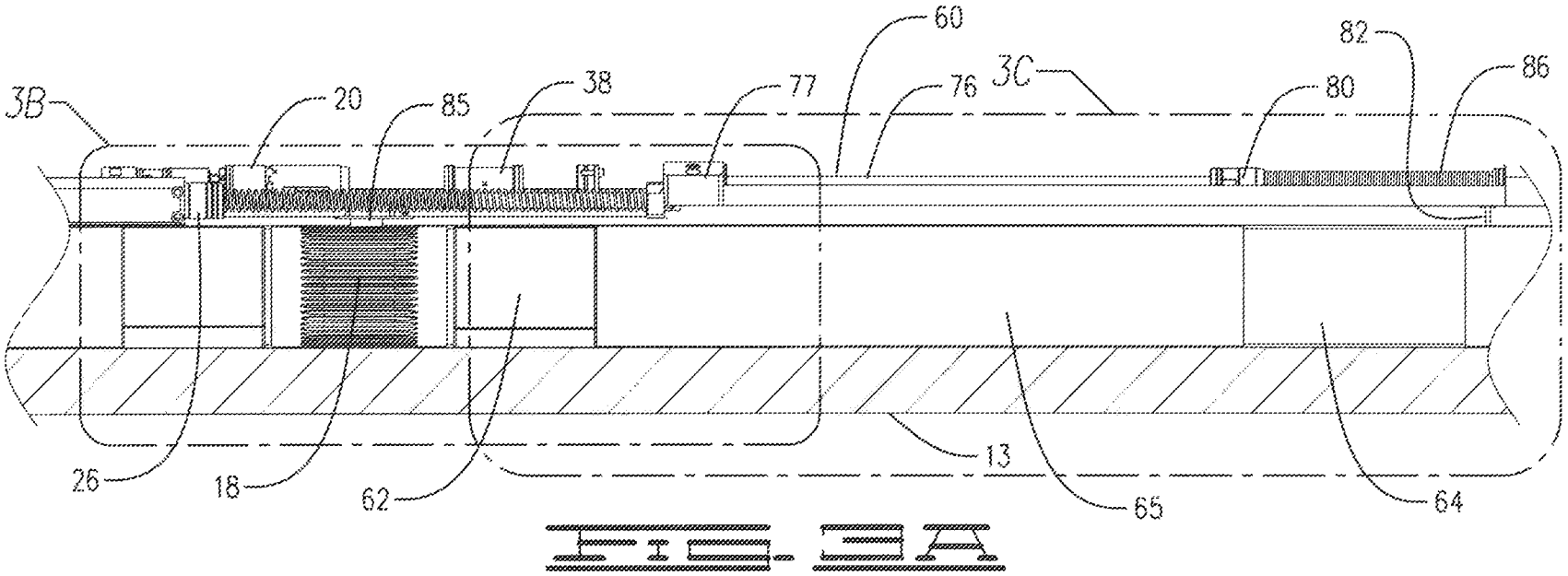
FIG. 3A PRIOR ART
FIG. 3A is a side cut-away view depicting the internal passageways of the prior art shaft lubricating block and the prior art hydraulic block.

The invention disclosed herein overcomes the deficiencies of prior art pressure compensation systems through a reconfiguration of the fluid flow passageways of the shaft lubricating block and hydraulic block. As used herein, the term "block" is used generically to designate a component of the bottom hole assembly. The use of the term "block" does not limit the geometric shape of the component. For example, in this instance "block" could also be a tube or other shape capable of being secured to main housing 13.

Through the reconfiguration of the fluid flow passageways, the present invention precludes the introduction of friction inducing debris to the passageways housing pistons necessary for balancing fluid pressures within the hydraulic block and shaft lubricating block. Additionally, the configuration of the improved pressure compensation system 100 provides an additive force to hydraulic fluid housed in hydraulic fluid reservoir 22 by providing a configuration wherein the force of a spring in shaft lubricating block 160 is conveyed to hydraulic block 116. The additive force improves operation of RSS 14 by ensuring a constant supply of hydraulic fluid to hydraulic pump 20.

Figure 5:
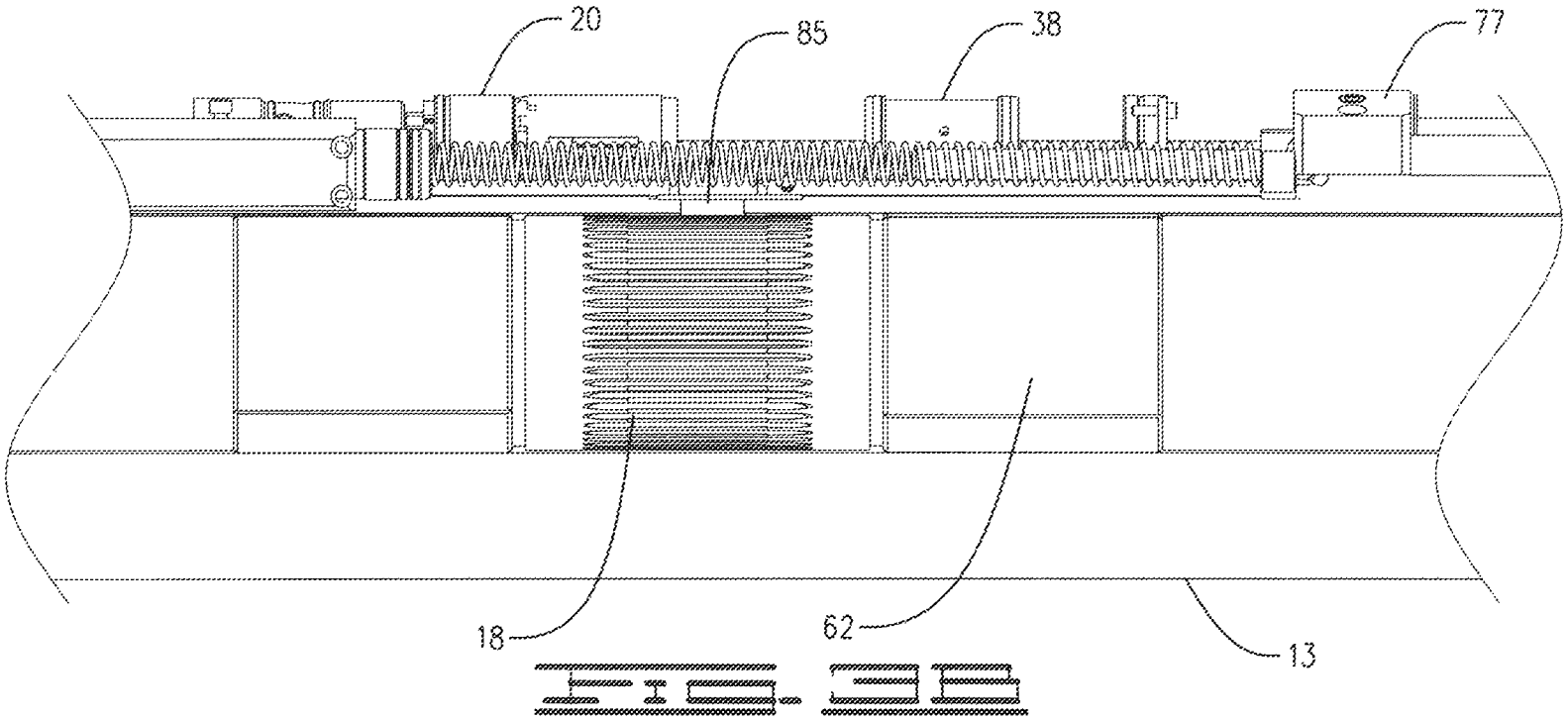
FIG. 5 PRIOR ART
FIG. 5A depicts a perspective cut-away view of one embodiment of the improved pressure compensation system of the present invention.
FIG. 5B is a perspective cut-away view of an improved hydraulic block as identified in portion 5B of FIG. 5A.
FIG. 5C is a perspective cut-away view of an improved shaft lubricating block as identified in portion 5C of FIG. 5A.
Figure 5:
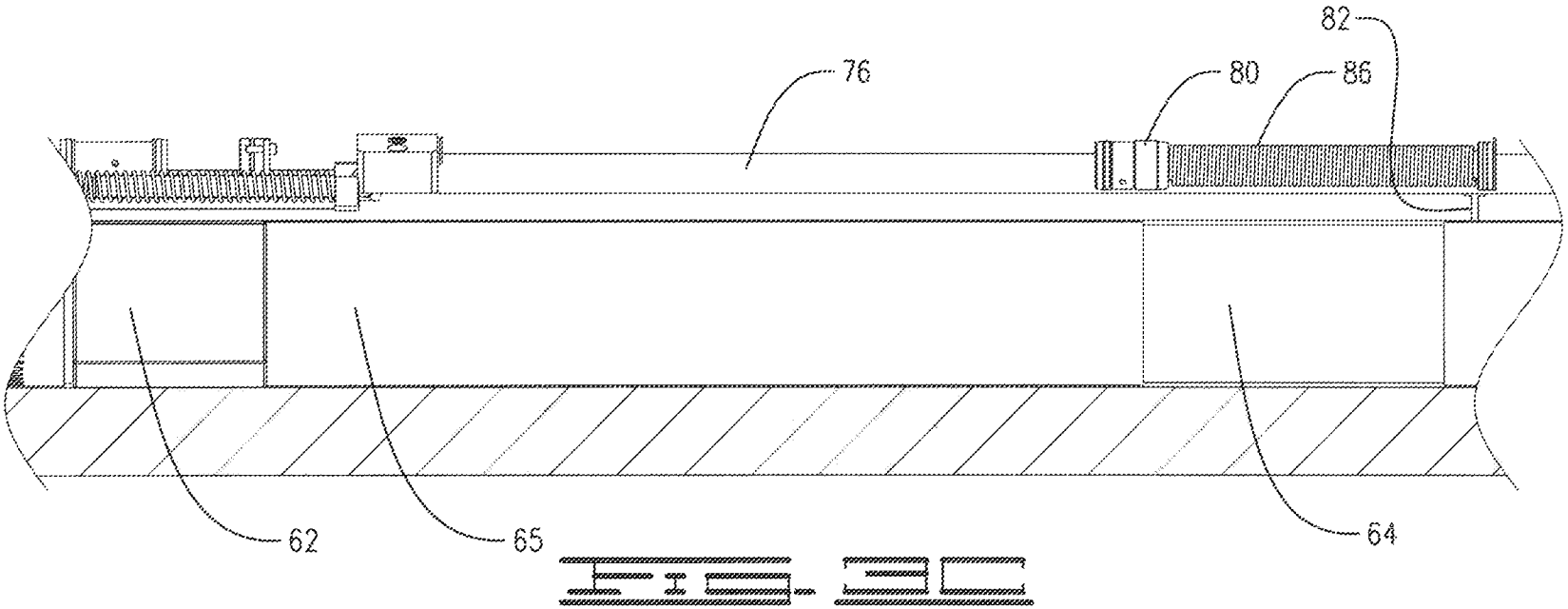
FIG. 5 PRIOR ART
Figure 4A:
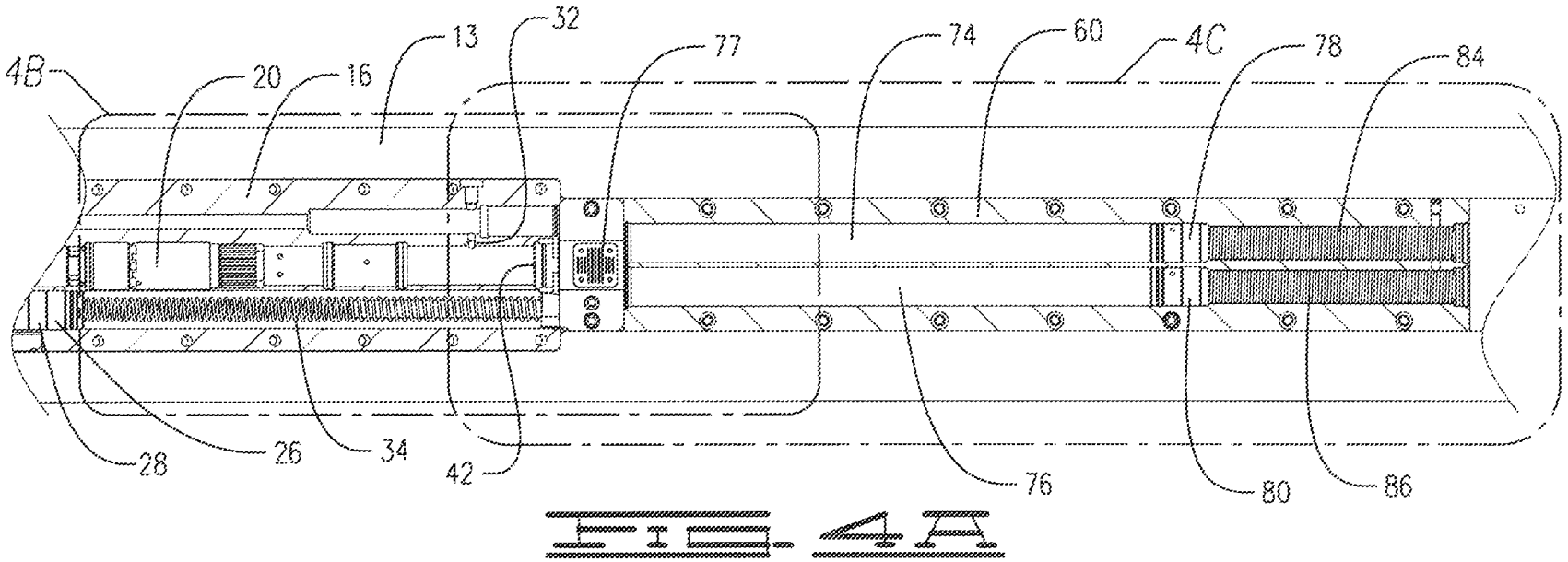
FIG. 4A PRIOR ART
FIG. 4A is a top cut-away view depicting the internal passageways of the prior art shaft lubricating block and the prior art hydraulic block.
Figure 4B:
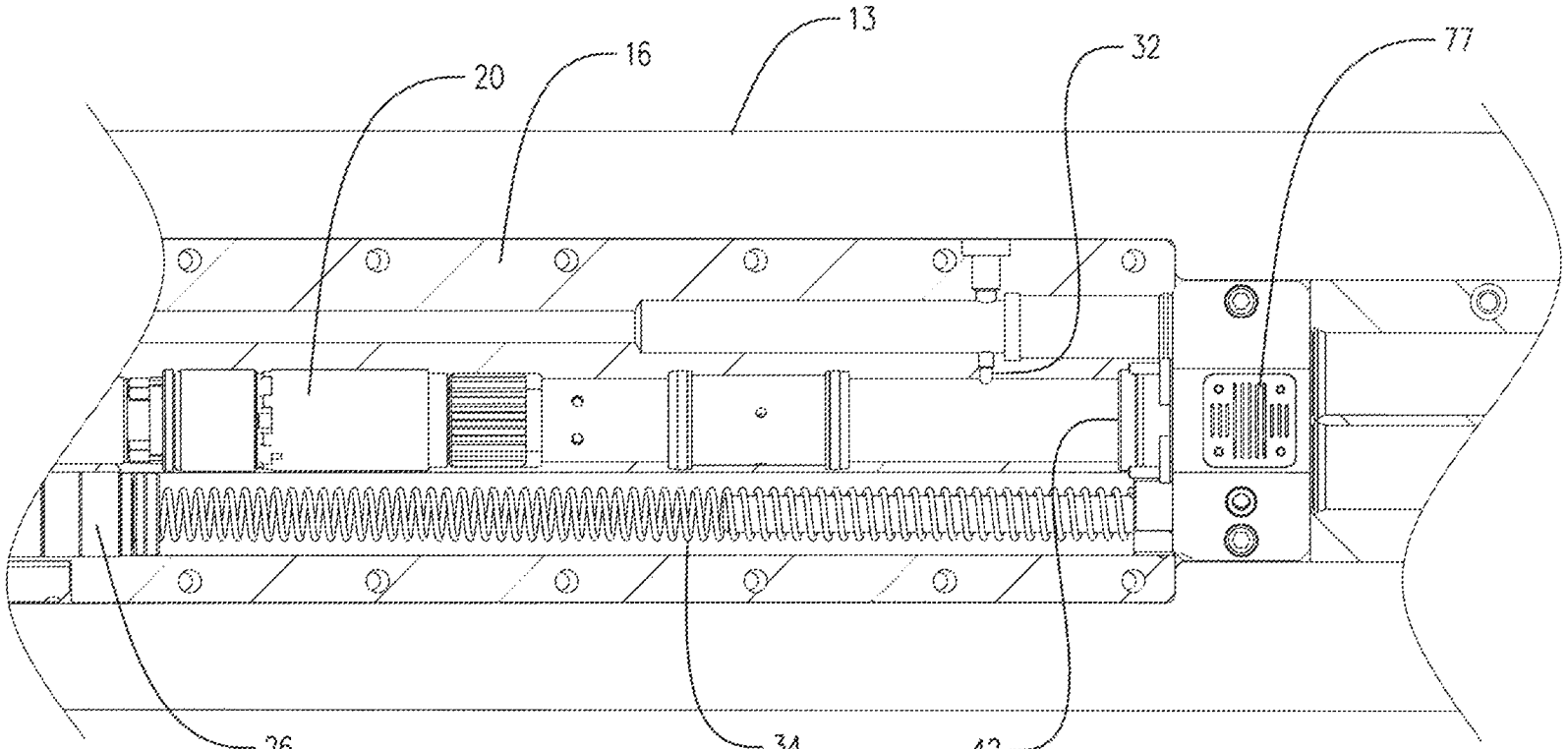
FIG. 4B PRIOR ART
FIG. 4B is a top cut-away view depicting the internal passageways of the prior art hydraulic block as identified in portion 4B of FIG. 4A.
Figure 4E:
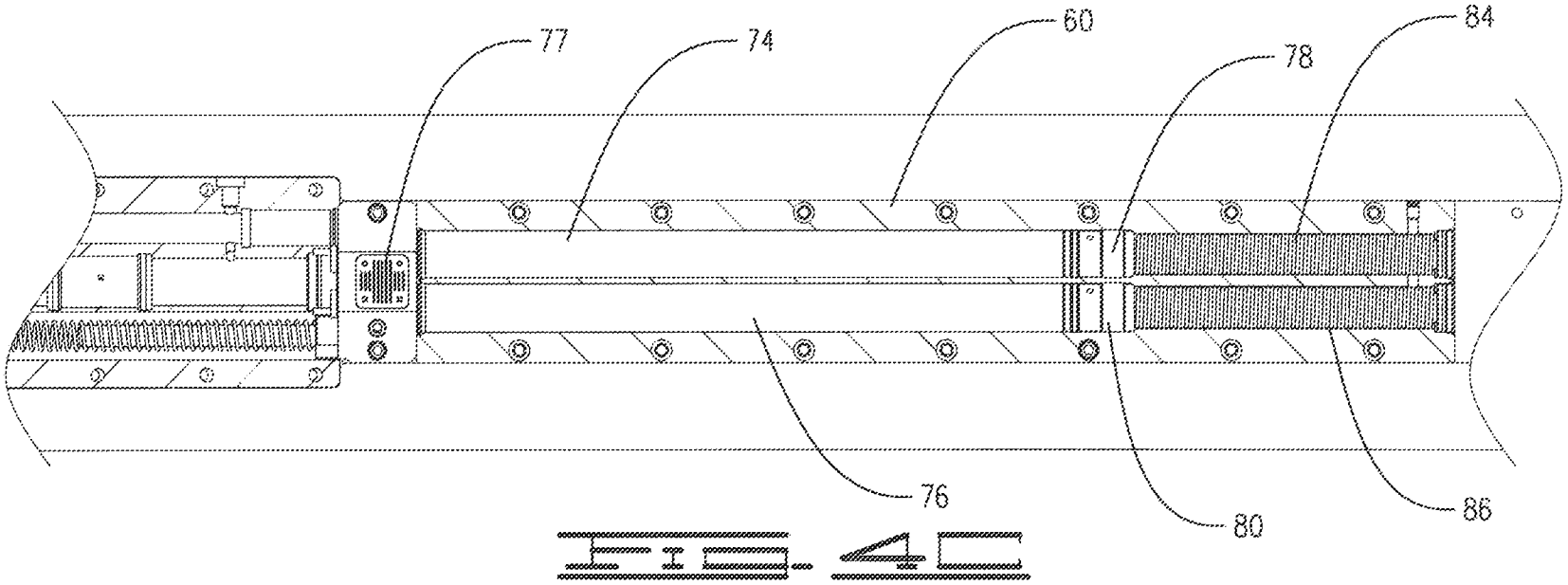
FIG. 4E PRIOR ART
FIG. 4C is a top cut-away view depicting the internal passageways of the prior art shaft lubricating block as identified in portion 4C of FIG. 4A.
Figure 5A:
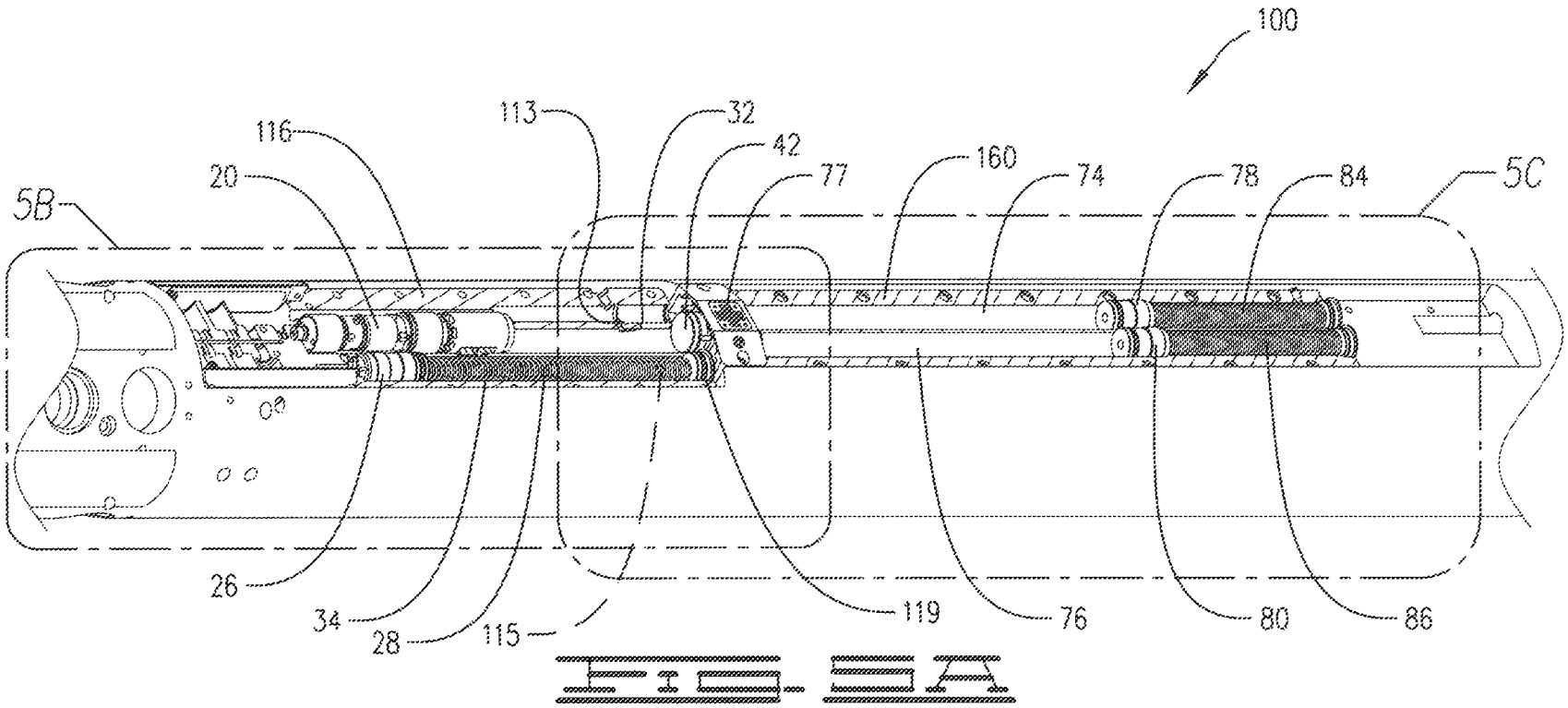
Figure 15:
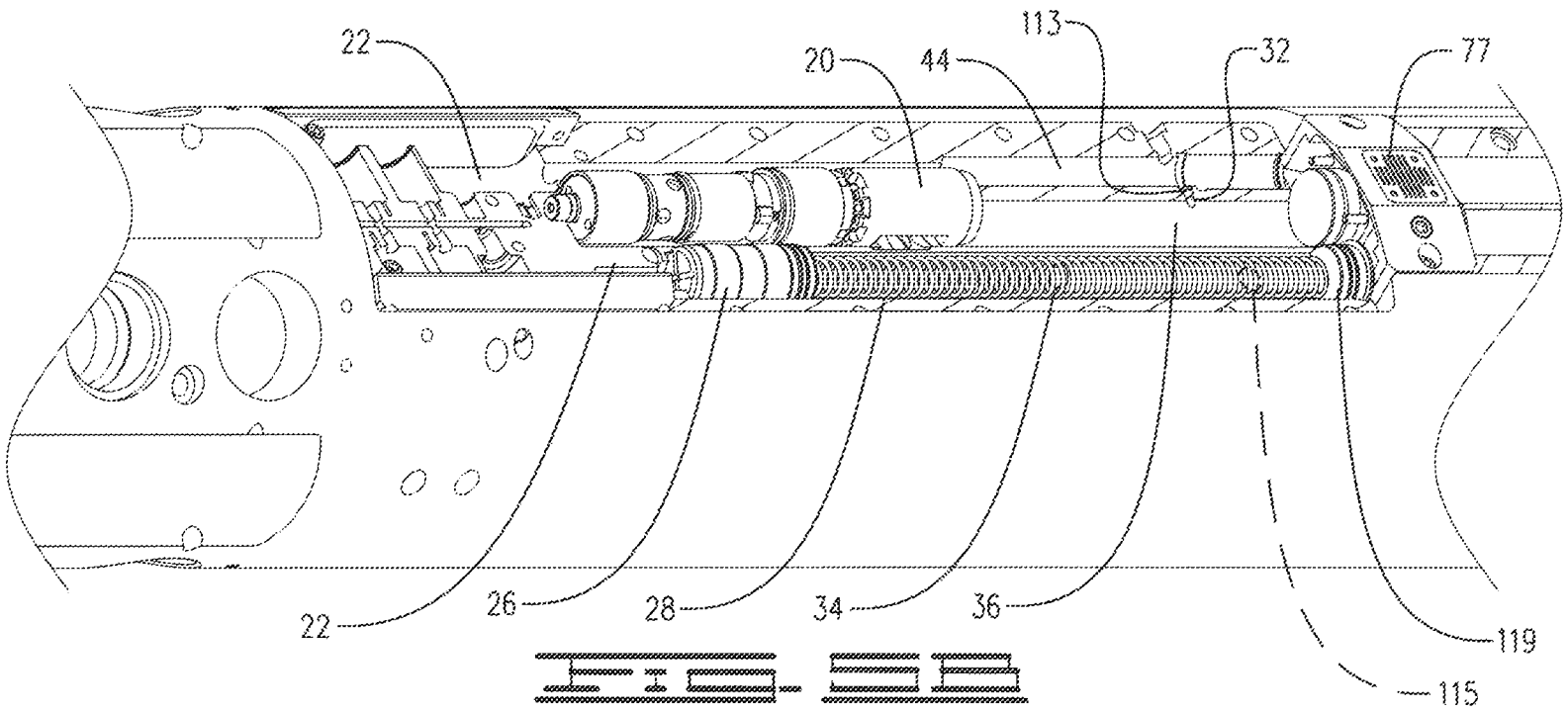
Figure 11:
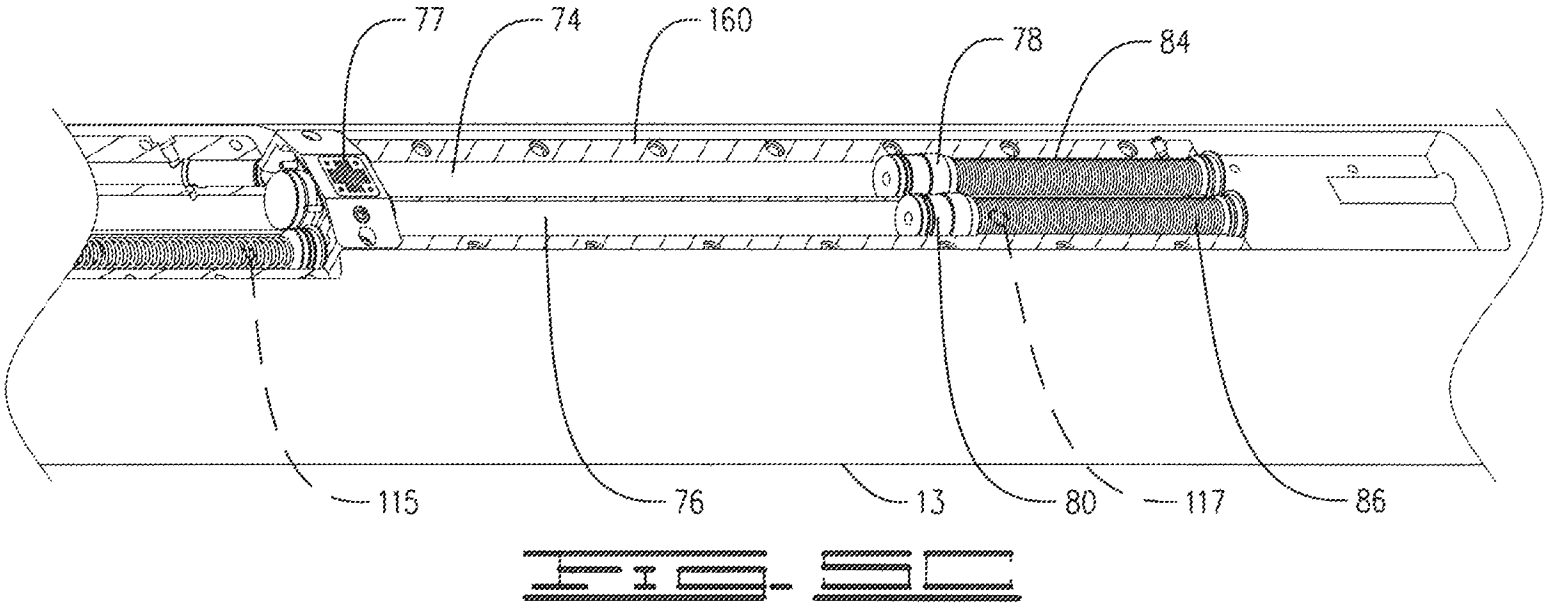

Additionally, as depicted, in FIGS. 5, 6 and 8, when provided as a retrofit, the improvement entails removal of floating piston 38, placing a plug 113 in port 32 and providing new fluid ports 115 and 117. Thus, plug 113 precludes entry of hydraulic fluid into passageway 36. In a retrofit embodiment of improved pressure compensation system 100, ports 82 and 85 will typically remain open. However, due to the lack of flow restrictions, lubricating oil will generally follow a path from shaft lubricating block 160 through port 117 to reservoir 65 to port 115 into hydraulic block 116. When constructed as a new device, improved pressure compensation system 100 will simply omit port 32 and optionally omit ports 82 and 85 while including new ports 115 and 117.

In one embodiment of improved pressure compensation system 100, placement of plug 119 at the uphole end of passageway 28 precludes mud access through port 77 into passageway 28 of hydraulic block 116. Thus, port 77 provides fluid communication between the interior of shaft lubricating block 160 and the wellbore annulus. In one embodiment of improved pressure compensation system 100, floating piston 38 has been eliminated from the uphole region of hydraulic block passageway 36. In retrofits where port 85 remains open, passageway 36 may be filled with lubricating fluid entering through port 85. In another embodiment of pressure compensation system 100, mud access to hydraulic block 116 has been eliminated, port 32 has been eliminated or plugged and floating piston 38 has been eliminated.

In improved compensation system 100, ambient pressure conveyed by drilling mud enters through port 77 and actuates pistons 78, 80 in passageways 74, 76. The mud pressure in combination with the springs 84, 86, ensures that the oil within oil reservoir 65 is maintained at a pressure between about 10 psi and about 50 psi above ambient pressure with a target pressure of about 30 psi above ambient pressure.

Although the disclosed embodiment of FIGS. 5-8 utilizes two passageways 74, 76 housing two pistons 78, 80 and two springs 84, 86, the improved system 100 will perform satisfactorily with a single passageway containing a single piston actuated by an appropriately biased spring will also provide the necessary pressure balancing force. Further, while the disclosed embodiment of FIGS. 5-8 depicts spring (s) 84, 86 on the uphole side of pistons 78, 80 as retracting springs, expanding, springs located on the downhole side of pistons 78, 80 are also contemplated by the present invention. Further, when using a single piston in shaft lubricating block 160, the associated spring may be located on either the uphole or the downhole side of the single piston. Likewise, the depicted embodiment places an expanding type spring 34 on the uphole side of compensation piston 26 in passageway 28. However, the present invention also contemplates the use of a retracting type spring on the downhole side of compensation piston 26, as either configuration will provide the required additional pressure compensation.

Figure 6A:
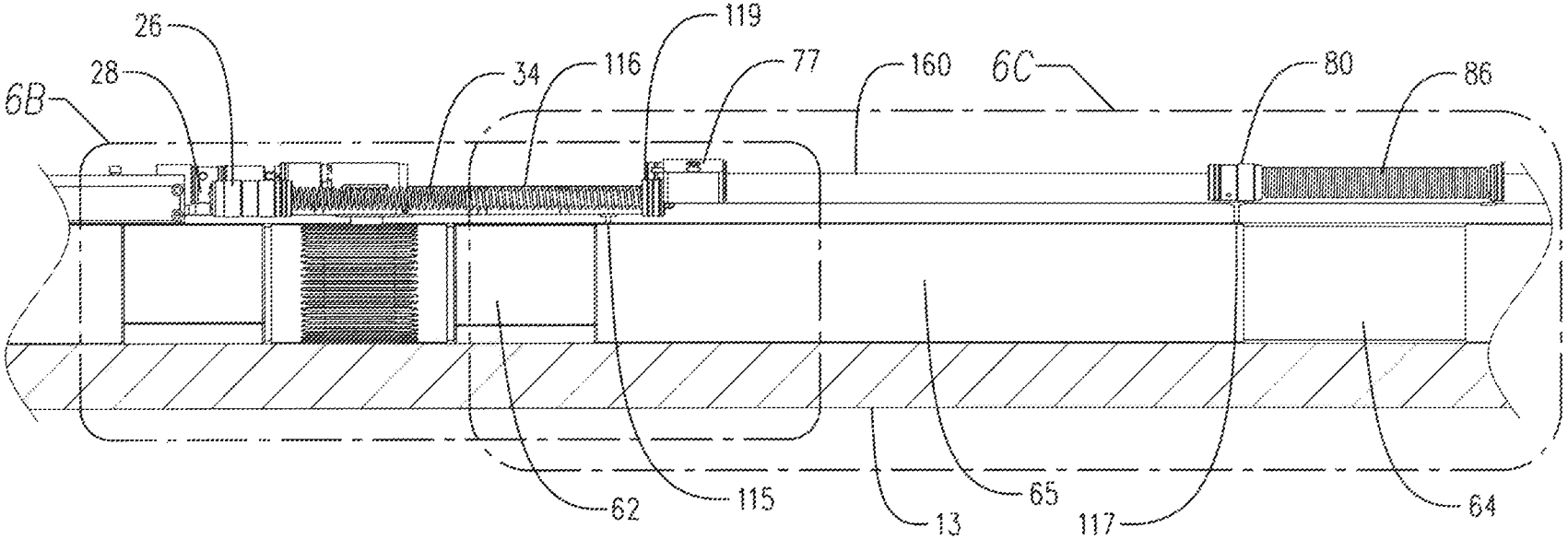
FIG. 6A is a side cut-away view of an improved pressure compensation system depicting the internal passageways of the shaft lubricating block and the hydraulic block.
Figure 11:
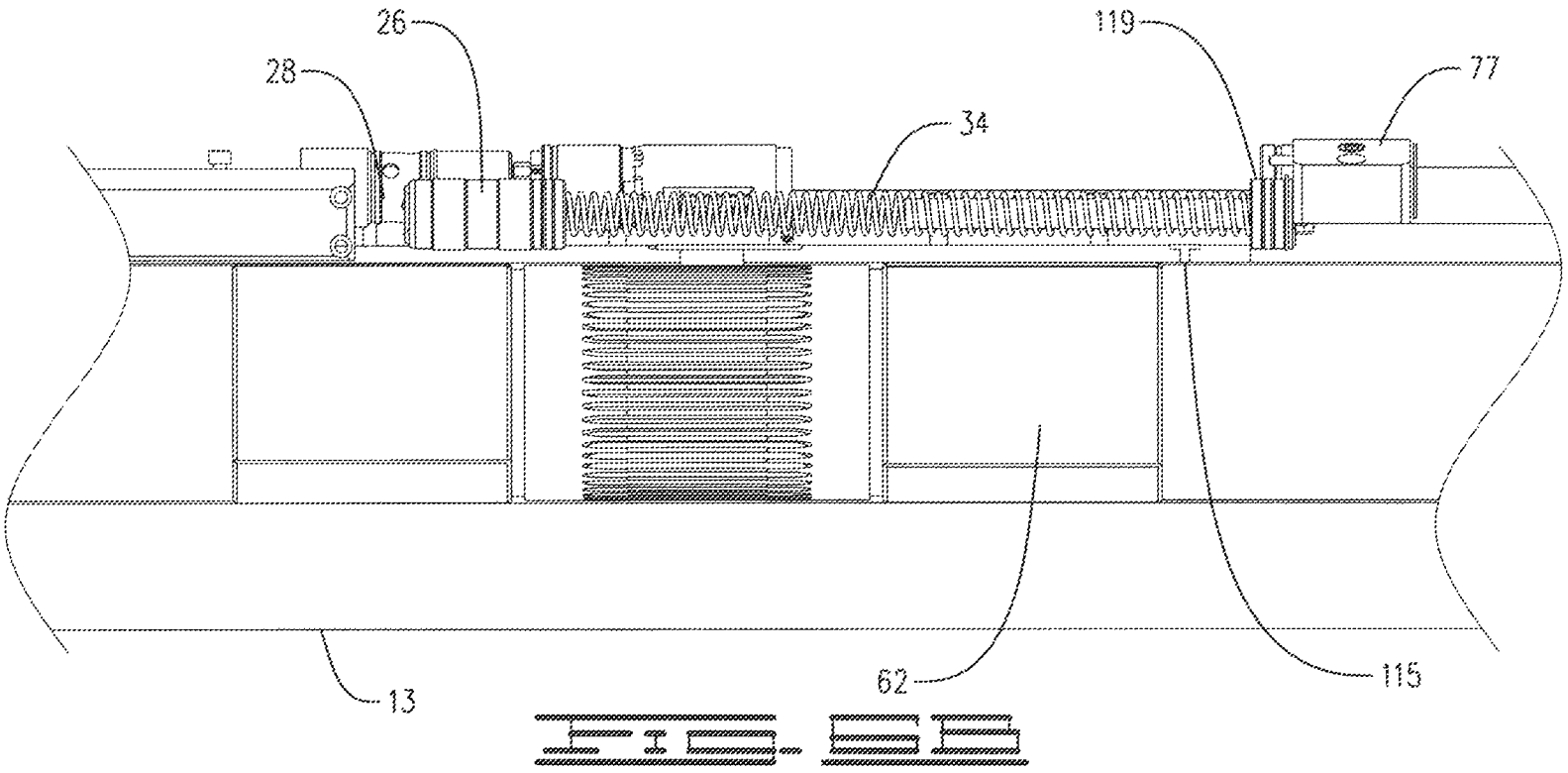
Figure 5C:
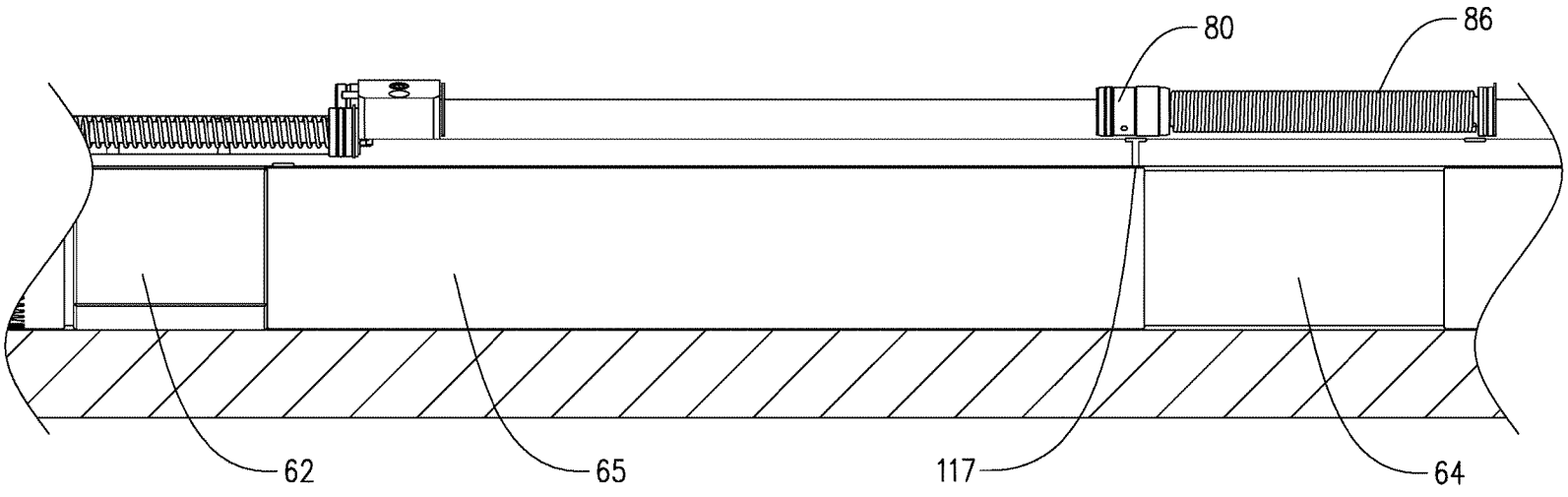
Figure 5D:
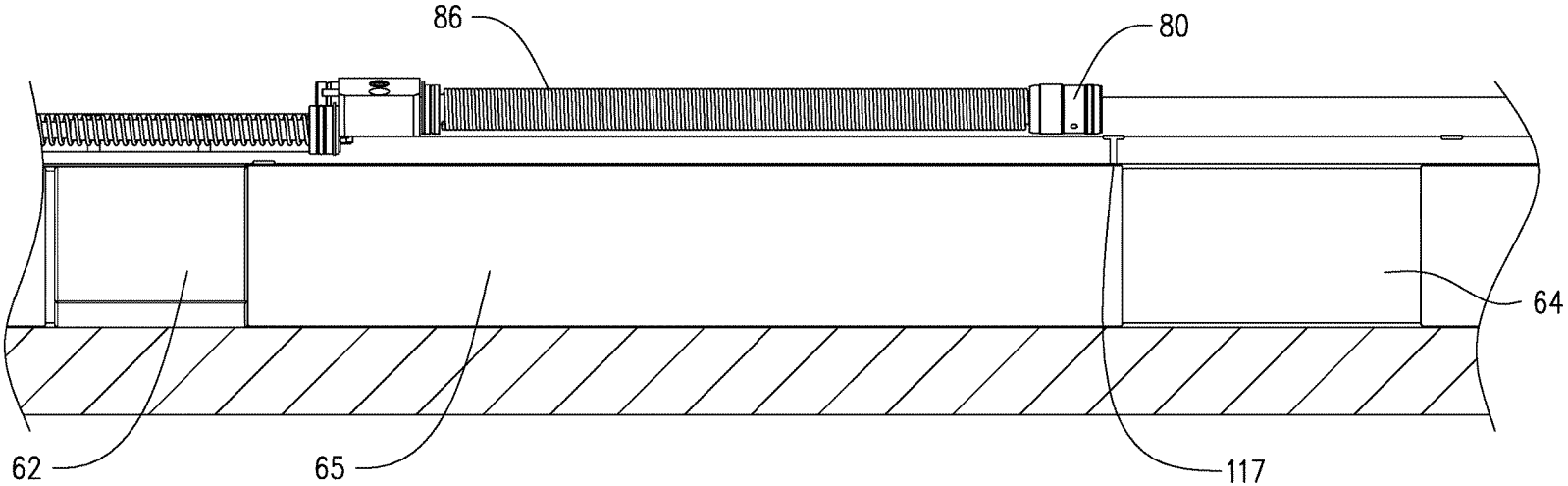
Figure 7:
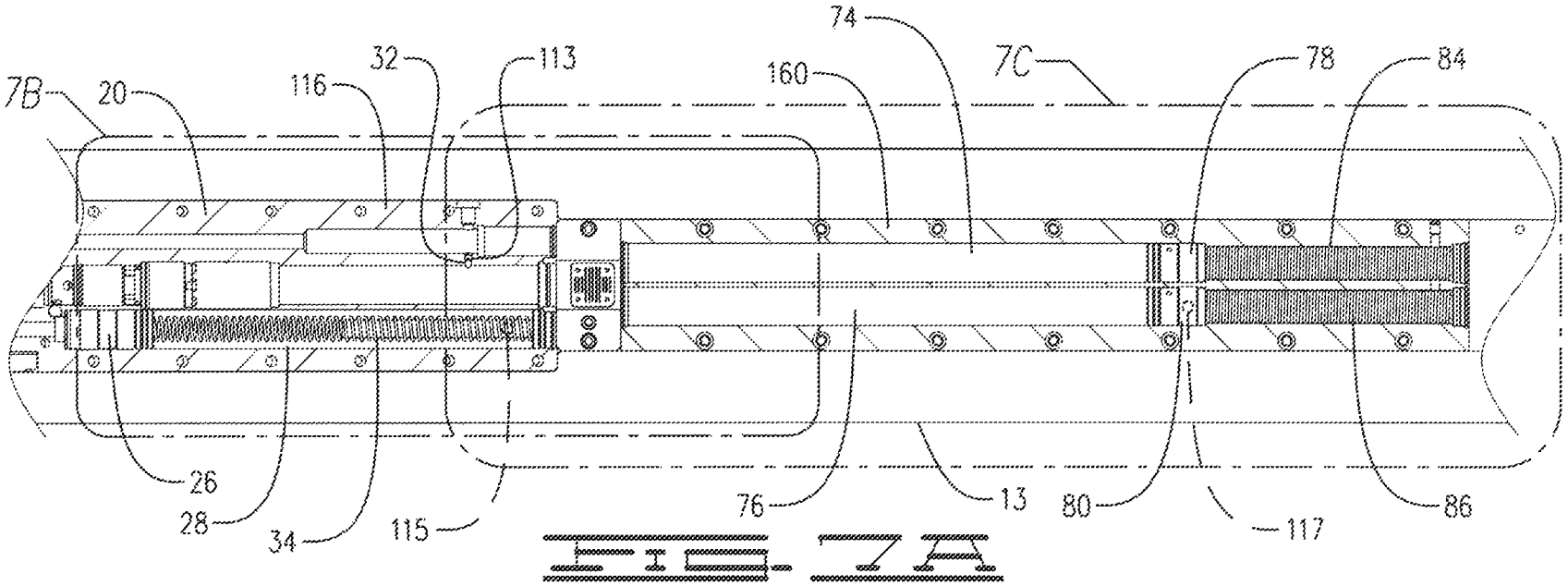
FIG. 7A is a top cut-away view of an improved pressure compensation system depicting the internal passageways of the shaft lubricating block and the hydraulic block.
FIG. 7B is a top cut-away view depicting the internal passageways of an improved hydraulic block as identified in portion 7B of FIG. 7A.
FIG. 7C is a top cut-away view depicting the internal passageways of an improved shaft lubricating block as identified in portion 7C of FIG. 7A.
Figure 17:
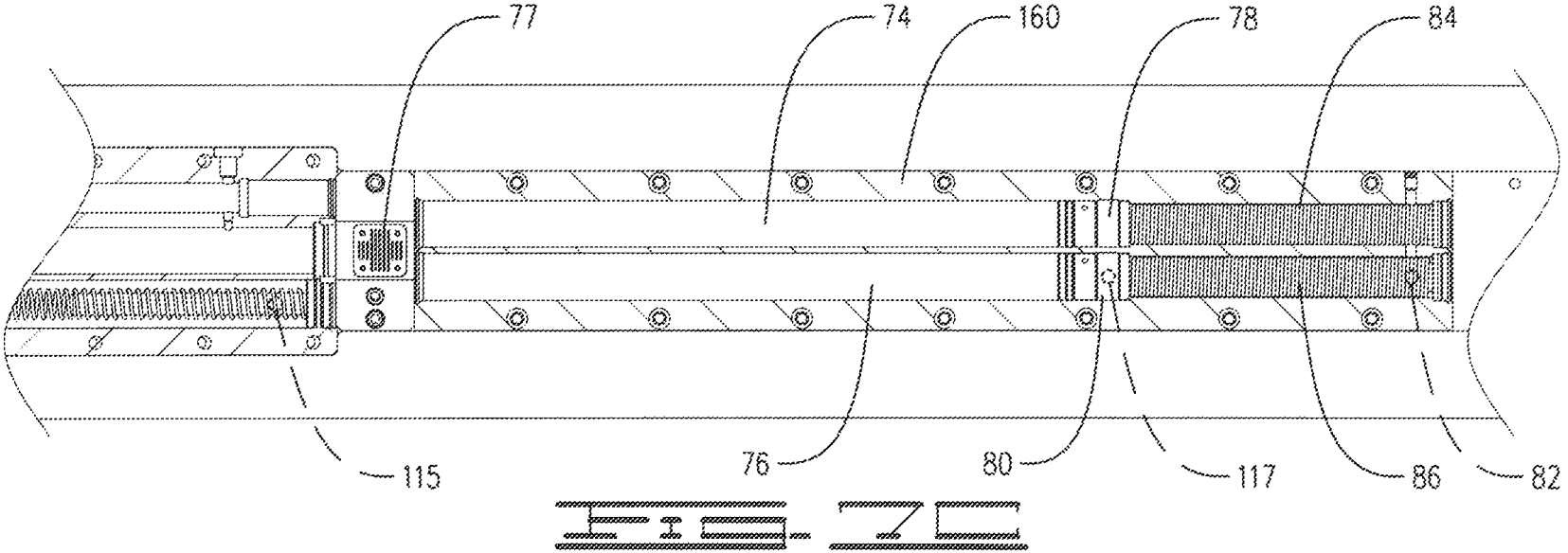
Figure 20:
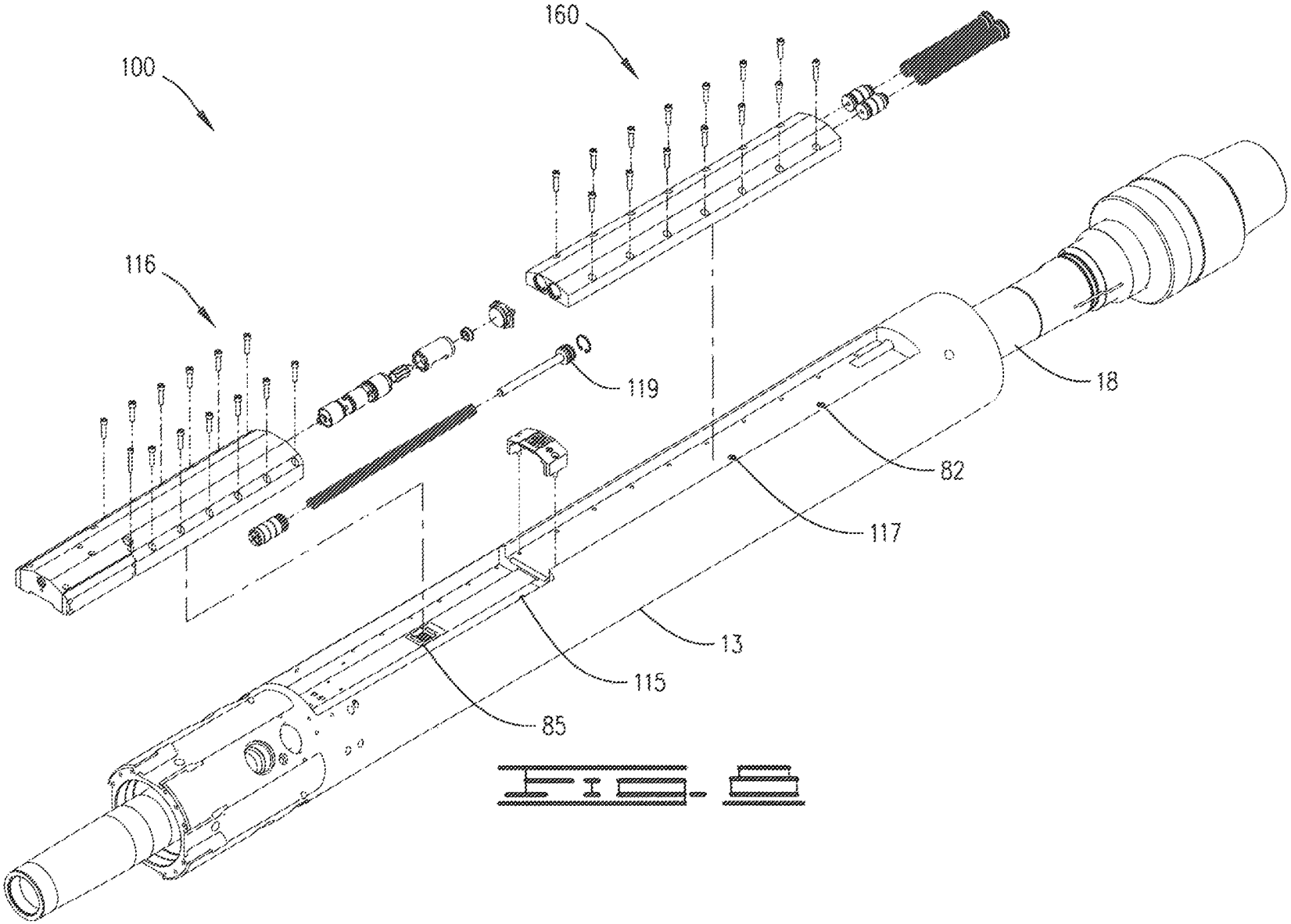

As depicted in FIGS. 6A and 7A, the provision of new fluid ports 115 and 117 provides fluid communication from passageways 74, 76 in shaft lubricating block 160 and passageway 28 of hydraulic block 116 to main housing 13 and oil reservoir 65. In the improved configuration, ports 115 and 117 provide a fluid flow path that allows oil to flow from passageways 74, 76 to oil reservoir 65 and then to hydraulic block 116 without passing through the constrictions introduced by first and second bearings 62, 64. Thus, as depicted, new fluid pons 115 and 117 are located between bearings 62, 64, i.e. port 117 is downhole of bearing 64 and port 115 is uphole of hearing 62. NOTE: to simplify the discussion and depiction of improved pressure compensation system 100, ports 115 and 117 have been depicted and described as single fluid communication passageways. However, one skilled in the art will recognize that port 115 consists of separate aligned fluid passageways found in both main housing 13 and hydraulic block 116. Likewise port 117 consists of separate aligned fluid passageways found in both main housing 13 and shaft lubricating block 160.

As noted above, if the unproved pressure compensation system 100 is a retrofit of a prior art system port 32 has been plugged. However, in a newly manufactured pressure compensation system 100, port 32 will be omitted. Thus, port 117 now provides fluid communication between shaft lubricating block 160 and oil reservoir 65 while port 115 provides fluid communication between oil reservoir 65 and hydraulic block 116. In this configuration, oil flows from shaft lubricating block 160 through ports 115 and 117 to hydraulic block 116 and passageway 28 housing compensation piston 26.

In view of the pressure applied to compensation piston 26 by oil in passageway 28, floating piston 38 has been eliminated from passageway 36. Additionally, the modification of the hydraulic block by the addition of plug 119 precludes entry of drilling mud into passageway 28. As a result, the improved pressure compensation system 100 precludes contamination of compensation piston 26 by drilling mud debris. Thus, modified hydraulic block 116 will no longer experience lags in pressure compensation due to drilling mud debris.

As depicted in FIGS. 5-8, the modified configuration provides pressure compensation through the application of drilling mud pressure passing into shaft lubricating block 160 via port 77 and impacting pistons 78, 80. Springs 84, 86 increase the internal pressure over that applied by the drilling mud such that shaft oil within oil reservoir 65 is maintained at about 10 psi to about 50 psi above ambient drilling mud pressure. Additionally, this configuration transmits, the force of springs 84, 86 to be conveyed to piston 26 within passageway 28 of hydraulic block 116 via ports 115 and 117.

As noted above, compensation piston 26 is associated with spring 34 which provides an additional additive force to ensure that compensation pressure applied to hydraulic fluid located within reservoir 22 remains at least about 10 psi to about 50 psi above ambient drilling mud pressure. Accordingly, the improved compensation system operates in a manner where the spring forces provided b springs 84, 86 and 84 are additive when applied to hydraulic fluid reservoir 22. The additive forces ensure a constant, adequate supply of hydraulic fluid to hydraulic pump 20 thereby precluding delayed operation of RSS 14 arms. Thus, improved pressure compensation system 100 enhances the operation of RSS 14.

Additionally, the modified fluid flow path, allows compensation piston 26 to act as a floating piston and as a separation point balancing the pressures of the hydraulic fluid system and the shaft lubricating block fluid system. Thus, elimination of floating piston 38 provides a more efficient and reliable pressure compensation system. The modified pressure compensation system requires drilling mud access to only shaft lubricating block 160 thereby isolating hydraulic block 116 from drilling mud debris. Finally, the elimination of the floating piston 38 from the uphole region of passageway 36 creates a void on the uphole side of hydraulic pump 20. This void may be filled with lubricating fluid, hydraulic fluid or may remain empty.

In the prior art system, the total drag force within pressure compensation system 10 resulting from compensation piston 26, floating piston 38 and pistons 78, 80 was approximately 50% to 71% of the available compensation pressure. Removal of floating piston 38 reduces overall frictional force within improved pressure compensation system 100 thereby reducing the drag force within hydraulic block 116. Further, as discussed below, to the configuration of improved pressure compensation system 100, the forces of springs 84, 86 and 34 are additive thereby providing an increase in compensation pressure available to hydraulic pump 20 within hydraulic block 116.

As discussed above, spring rates for each spring in improved pressure compensation system 100 may range from about 5 psi to about 50 psi. Thus, because of the additive spring forces and reduced drag force resulting from the removal of floating piston 38 resulting drag three within improved pressure compensation system 100 is only about 11% to 17% of available compensation pressure. Thus, improved pressure compensation system 100 preferably operates with about 10% to 35% of available compensation pressure dedicated to operation of compensation piston 26.

The present invention also provides a method. for retrofitting a prior art compensation system to the a hove described improved pressure compensation system 100. The method entails removal of hydraulic block 16 and shaft lubricating block 60 from main housing 13. Following removal of hydraulic block 16, port 32 is plugged using any convenient means and plug 119 inserted in passageway 28 to block mud access from port 77 to passageway 28. Additionally, new port 115 is drilled providing fluid access to passageway 34. A corresponding port 115 is drilled within main housing 13 to provide fluid access to reservoir 65. Optionally, floating piston 38 is removed from passageway 36. Similarly, new port 117 is drilled in shaft lubricating block 60 to provide fluid access to the one or more passageways housing spring actuated pistons in shaft lubricating block 60. A corresponding port is drilled in main housing 13 to provide fluid access to reservoir 65. As discussed above, new port 115 will be uphole of the downhole shaft bearing 62 and new port 117 will be downhole of shaft bearing 64 to provide an unobstructed flow path for lubricating oil within reservoir 65 from the one or more passageways housing spring actuated pistons in shaft lubricating block 60 to passageway 34 of hydraulic block 16.

Other embodiments of the present invention will be apparent to one skilled in the art. As such, the foregoing description merely enables and describes the general uses and methods of the present invention. Accordingly, the following claims define the true scope of the present invention.

What is claimed:

1. A downhole tool comprising:

main housing supporting a hydraulically actuated tool, a shaft lubricating block, a hydraulic block and a drilling mud access port;

a rotatable shaft passing through said main housing;

said main housing comprises;

a shaft oil reservoir containing shaft oil;

a first bearing supporting said shaft passing through said main housing, said first bearing immerged in said shaft oil contained within said shaft oil reservoir;

a second bearing supporting said shaft passing through said main housing, said second bearing immersed in said shaft oil contained within said shaft oil reservoir;

said shaft lubricating block comprises:

at least one shaft lubricating block passageway having a uphole end and a downhole end;

a piston positioned within said at least one shaft lubricating block passageway, said piston having an uphole side and downhole side and said piston divides said at least one shaft lubricating block passageway into an uphole region and a downhole region;

a first fluid port providing fluid communication between said at least one shaft lubricating block passageway and said shaft oil reservoir, said first fluid port located downhole of said first bearing;

wherein to said uphole region of said at least one shaft lubricating block passageway contains shaft oil; and, a spring located in either said uphole region or said downhole region of said at least one shaft lubricating block passageway, said spring applies a biasing force against said piston such that said piston applies pressure to shaft oil located within said shaft oil reservoir;

said hydraulic block comprises:

a first hydraulic block passageway having an uphole end and downhole end;

a piston positioned within said first hydraulic block passageway, said piston positioned within said first hydraulic block passageway having an uphole side and a downhole side and said piston positioned within said first hydraulic block passageway divides said first hydraulic block passageway into an uphole region and a downhole region;

a second fluid port providing fluid communication between said uphole region of said first hydraulic block passageway and said shaft oil reservoir, said second fluid port located uphole of said second bearing; and, said drilling mud access port is in fluid communication with the downhole region of said at least one passageway of said shaft lubricating block.

2. The downhole tool of claim 1, wherein said spring located in either said uphole region or said downhole region of said at least one shaft lubricating block passageway applies a biasing pressure of about 5 psi to about 50 psi to said piston located in said at least one shaft lubricating block passageway.

3. The downhole tool of claim 1, further comprising a second spring located in said first at least one hydraulic block passageway, said second spring located on either said uphole side or downhole side of said piston positioned within said first least one hydraulic block passageway and said second spring applies a biasing pressure of about 5 psi to about 50 psi to said piston positioned within said first least one hydraulic block passageway.

4. The downhole tool of claim 1, wherein a pathway between said first fluid port and said second fluid port is unobstructed.

5. The downhole tool of claim 3, wherein the total drag force of said piston positioned within said at least one shaft lubrication block passageway and said piston positioned within said first hydraulic block passageway is between about 10% and about 40% of the total compensation pressure generated by said spring located in said shaft lubricating block passageway and said second spring located in said at least one hydraulic block passageway.

6. The downhole tool of claim 3, wherein the total drag force of said piston positioned within said at least one shaft lubrication block passageway and said piston positioned within said first hydraulic block passageway is between about 11% and about 17% of the total compensation pressure generated by said spring located in said shaft lubricating block passageway and said second spring located in said at least one hydraulic block passageway.

7. A downhole tool comprising:

a main housing supporting a hydraulically actuated tool, a shaft lubricating block, a hydraulic block and a drilling mud access port;

a rotatable shaft passing through said main housing;

said main housing comprises;

a shaft oil reservoir containing shaft oil;

a first bearing supporting said shaft passing through said main housing, said first bearing immersed in said shaft oil contained within said shaft oil reservoir;

a second bearing supporting said shaft passing through said main housing, said second bearing immersed in said shaft oil contained within said shaft oil reservoir;

said hydraulic block comprises;

a first hydraulic block passageway having uphole end and a downhole end;

a piston located in said first hydraulic block passageway said piston divides said first hydraulic block passageway into an uphole region and downhole region;

a first port located uphole of said second bearing provides fluid communication between said uphole region of said first hydraulic block passageway and said shaft oil reservoir;

a spring located in either said uphole or downhole region of said first hydraulic block passageway;

a hydraulic fluid reservoir within said hydraulic block, said hydraulic fluid reservoir contains hydraulic fluid;

a second port providing fluid communication between said hydraulic fluid reservoir and said downhole region of said first hydraulic block passageway;

a second hydraulic block passageway, said second hydraulic block passageway in fluid communication with said hydraulic fluid reservoir and housing a hydraulic pump;

at least a third passageway providing fluid communication between said hydraulic pump and said hydraulically actuated tool;

the configuration of said hydraulic block precluding fluid communication between said first, second and third passageways of said hydraulic block and the exterior of said downhole tool.

8. The downhole tool of claim 7, wherein downhole region of said first hydraulic block passageway contains said hydraulic fluid and said spring located in either said uphole region or said downhole region of said first hydraulic block passageway applies a biasing pressure of about 5 psi to about 50 psi in the downhole direction to said piston located in said first hydraulic block passageway.

9. The downhole tool of claim 7, wherein said hydraulic pump divides said second hydraulic block passageway into an uphole region and a downhole region and said uphole region of said second hydraulic block passageway does not contain a floating piston.

10. A downhole tool comprising:

a main housing supporting a hydraulically actuated tool, a shaft lubricating block, a hydraulic block and a drilling mud access port;

a rotatable shaft passing through said main housing;

said main housing comprises:

a shaft oil reservoir containing shaft oil;

a first bearing supporting said shaft passing through said main housing, said first bearing immersed in said shaft oil contained within said shaft oil reservoir;

a second bearing supporting said shaft passing through said main housing, said second hearing immersed in said shaft oil contained within said shaft oil reservoir;

said hydraulic block comprises:

a first hydraulic block passageway having an uphole end and a downhole end;

a piston located in said first hydraulic block passageway, said piston divides said first hydraulic block passageway into an uphole region and a downhole region;

a port located uphole of said second bearing provides fluid communication between said uphole region of said first hydraulic block passageway and said shaft oil reservoir;

a spring located in either said uphole or downhole region of said first hydraulic block passageway, wherein said uphold region of said first hydraulic block passageway contains shaft oil;

a hydraulic fluid reservoir within said hydraulic block, said hydraulic fluid reservoir contains hydraulic fluid;

a port providing fluid communication between said hydraulic fluid reservoir and said downhole region of said first hydraulic block passageway;

a second hydraulic block passageway said second hydraulic block passageway in fluid communication with said hydraulic fluid reservoir and housing a hydraulic pump, said second hydraulic block passageway divided by said hydraulic pump into a downhole region and an uphole region, said uphole region of said second hydraulic block passageway does not contain a floating piston;

at least a third passageway providing fluid communication between said hydraulic pump and said hydraulically actuated tool.

11. The downhole tool of claim 10, wherein downhole region of said first hydraulic block passageway contains said hydraulic fluid and said spring located in either said uphole region or said downhole region of said first hydraulic block passageway applies a biasing pressure of about 5 psi to about 50 psi in the downhole direction to said piston located in said first hydraulic block passageway.

12. A downhole tool comprising:

a main housing supporting a hydraulically actuated tool, a shaft lubricating block, a hydraulic block and a drilling mud access port;

a rotatable shaft passing through said main housing;

said main housing comprises:

a shaft oil reservoir containing shaft oil;

a first bearing supporting said shaft passing through said main housing, said first bearing immersed in said shaft oil contained within said shaft oil reservoir;

a second bearing supporting said shaft passing through said main housing, said second hearing immersed in said shaft oil contained within said shaft oil reservoir;

said shaft lubricating block comprises:

at least one shaft lubricating block passageway having an uphole end and a downhole end;

a piston positioned within said at least one shaft lubricating block passageway, said piston having an uphole side and a downhole side and said piston divides said at least one shaft lubricating block passageway into an uphole region and a downhole region;

a first fluid port providing fluid communication between said at least one shaft lubricating block passageway and said shaft oil reservoir, said first fluid port located downhole of said first bearing;

wherein said uphole region of said at least one shaft lubricating block passageway contains shaft oil; and, a spring located in either said uphole region or said downhole region of said at least one shaft lubricating block passageway, said spring applies a biasing force against said piston such that said piston applies pressure to shaft oil located within said shaft oil reservoir;

said hydraulic block comprises:

a first hydraulic block passageway having an uphole end and a downhole end;

a piston positioned within said first hydraulic block passageway, said piston positioned within said first hydraulic block passageway having an uphole side and a downhole side and said piston positioned within said first hydraulic block passageway divides said first hydraulic block passageway into an uphole region and a downhole region;

a second fluid port providing fluid communication between said uphole region of said first hydraulic block passageway and said shaft of reservoir, said second fluid port located uphole of said second bearing;

a spring located in either said uphole or downhole region of said first hydraulic block passageway;

a hydraulic fluid reservoir within said hydraulic block, said hydraulic fluid reservoir contains hydraulic fluid;

a third port providing fluid communication between said hydraulic fluid reservoir and said downhole region of said first hydraulic block passageway;

a second hydraulic block passageway, said second hydraulic block passageway in fluid communication with said hydraulic fluid reservoir;

a hydraulic pump positioned within said second hydraulic block passageway, said hydraulic pump dividing said second hydraulic block passageway into an uphole region and a downhole region, said uphole region of said second hydraulic block passageway does not contain a floating piston;

at least a third passageway providing fluid communication between said hydraulic pump and said hydraulically actuated tool; and;

the configuration of said hydraulic block precludes fluid communication between said first, second and third hydraulic block passageways and the exterior of said downhole tool;

said drilling mud access port in fluid communication with the downhole region of said at least one passageway of said shaft lubricating block.

13. The downhole tool of claim 12, wherein said spring located in either said uphole region or said downhole region of said at least one shaft lubricating block passageway applies a biasing pressure of about 5 psi to about 50 psi to said piston located in said at least one shaft lubricating block passageway.

14. The downhole tool of claim 12, wherein downhole region of said first hydraulic block passageway contains said hydraulic fluid and said spring located in either said uphole region or said downhole region of said first hydraulic block passageway applies a biasing pressure of about 5 psi to about 50 psi in the downhole direction to said piston located in said first hydraulic block passageway such that said piston located in said first hydraulic block passageway applies pressure to said hydraulic fluid located within said hydraulic fluid reservoir.

15. The downhole tool a claim 14, wherein said pressure applied by said spring located in said at least one shaft lubricating block passageway to said piston positioned within said at least one shaft lubricating block passageway and said pressure applied by said spring located within said first hydraulic block passageway to said piston located within said first hydraulic block passageway are additive forces applied to said hydraulic fluid within said hydraulic fluid reservoir.

16. The downhole tool of claim 12, wherein a pathway between said first fluid port and said second fluid port is unobstructed.

17. The downhole tool of claim 12, wherein the total drag force of said piston positioned within said at least one shaft lubrication block passageway and said piston positioned within said first hydraulic block passageway is between about 10% and about 40% of the total compensation pressure generated by said spring located in said shaft lubricating block passageway and said second spring located in said at least one hydraulic block passageway.

18. The downhole tool of claim 12, wherein the total drag force of said piston positioned within said at least one shaft lubrication block passageway and said piston positioned within said first hydraulic block passageway is between about 11% and about 17% of the total compensation pressure generated by said spring located in said shaft lubricating block passageway and said second spring located in said at least one hydraulic block passageway.

* * * * *